US009088091B2

(12) United States Patent
Suzuki et al.

(10) Patent No.: US 9,088,091 B2
(45) Date of Patent: Jul. 21, 2015

(54) CONNECTOR WITH WIRE COVER

(71) Applicant: Yazaki Corporation, Tokyo (JP)

(72) Inventors: Kenji Suzuki, Makinohara (JP); Motoyoshi Suzuki, Makinohara (JP); Tomoki Hatakeyama, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/363,900

(22) PCT Filed: Dec. 27, 2012

(86) PCT No.: PCT/JP2012/084300
§ 371 (c)(1),
(2) Date: Jun. 9, 2014

(87) PCT Pub. No.: WO2013/100193
PCT Pub. Date: Jul. 4, 2013

(65) Prior Publication Data

US 2014/0357116 A1 Dec. 4, 2014

(30) Foreign Application Priority Data

Dec. 27, 2011 (JP) ..... 2011-286393

(51) Int. Cl.

| | |
|---|---|
| ***H01R 13/58*** | (2006.01) |
| ***H01R 13/516*** | (2006.01) |
| ***H01R 13/447*** | (2006.01) |
| ***H01R 13/50*** | (2006.01) |

(Continued)

(52) U.S. Cl.
CPC ..... *H01R 13/516* (2013.01); *H01R 13/447* (2013.01); *H01R 13/501* (2013.01); *H01R 13/506* (2013.01); *H01R 13/567* (2013.01); *H01R 13/5213* (2013.01)

(58) Field of Classification Search
CPC .. H01R 13/516; H01R 13/447; H01R 13/506; H01R 13/567; H01R 13/501; H01R 13/5213
USPC ..... 439/455
See application file for complete search history.

(56) References Cited

U.S. PATENT DOCUMENTS 5,688,144 A * 11/1997 Kosuge ..... 439/596
6,962,504 B2 * 11/2005 Fukui et al. ..... 439/466

(Continued)

FOREIGN PATENT DOCUMENTS

JP 2001-143812 A 5/2001
JP 2004-127813 A 4/2004

OTHER PUBLICATIONS

International Search Report for PCT/JP2012/084300 dated May 6, 2013 [PCT/ISA/210].

(Continued)

*Primary Examiner* — Jean F Duverne
(74) *Attorney, Agent, or Firm* — Sughrue Mion, PLLC

(57) ABSTRACT

In a connector with a wire cover, one of attachment portions provided in a main body cover is extended beyond a maximum diameter portion of a cover mounting portion in a direction perpendicular to an attachment direction in which the attachment portion is mounted on the cover mounting portion. The one of the attachment portions includes a provisional engagement portion provisionally engaged on the cover mounting portion, and configured to prevent the attachment portion from being detached from the cover mounting portion. The main body cover includes a rotation restricting portion configured to come in contact with a connector housing to prevent a rotation of the main body cover when a rotational force is applied to the main body cover in a circumferential direction of the cover mounting portion in a state where the provisional engagement portion is provisionally engaged with the cover mounting portion.

2 Claims, 19 Drawing Sheets

(51) Int. Cl. *H01R 13/506* (2006.01)
*H01R 13/56* (2006.01)
*H01R 13/52* (2006.01)

(56) References Cited

U.S. PATENT DOCUMENTS 7,494,376 B1 2/2009 Foltz
2004/0102082 A1 5/2004 Tsuji et al.
2007/0093120 A1 4/2007 Hardy et al.
2011/0237117 A1 9/2011 Lim

OTHER PUBLICATIONS

Written Opinion for PCT/JP2012/084300 dated May 6, 2013 [PCT/ISA/237].

* cited by examiner

*FI*G. 13

CONNECTOR WITH WIRE COVER

TECHNICAL FIELD

The present invention is related to a connector provided with a wire cover.

BACKGROUND ART

An electrical connector provided with a wire cover is used in a case where a space for wiring at a rear side is not enough due to an attachment position of the connector so that wires need to be bent at close vicinity of a rear surface of a connector housing. Further, such an electrical connector provided with a wire cover is used in a case where a rear surface side of the connector housing is simplicity waterproofed with the wire cover. As conventional arts, PTL 1 or PTL 2 have been well-known.

The connector includes a connector housing into which a terminal fixed to an end of a wire is inserted from a rear surface side thereof, and a wire cover which is divided into two half pieces and is mounted on a rear end portion of the connector housing. The connector is configured to allow wires pulled out from a rear portion of the connector housing to pass through the interior of the wire cover and then to be pulled out in an orthogonally-bent direction.

In the connector provided with the wire cover according to the conventional arts, each of the divided covers is provided at an end portion of an attachment portion attached to the connector housing with a fitting tube divided into two half portions. The fitting tube is positioned and inserted at the outer periphery of the rear end portion of the connector housing. Each of the divided covers is provided with a locking portion which locks each other at an abutting end edge of each of the divided covers. Only after both the divided covers are fitted on each other to be locked together, the wire cover itself is attached to the rear end portion of the connector housing.

CITATION LIST

Patent Literature

[PTL 1] JP-A-2004-127813
[PTL 2] JP-A-2001-143812

SUMMARY OF INVENTION

Technical Problem

It is therefore one advantageous aspect of the present invention to provide a connector provided with a wire cover that can be attached to a connector housing easily with one hand thereby providing good workability in assembly.

Solution to Problem

According to one aspect of the present invention, there is provided a connector with a wire cover, comprising:

a connector housing having a terminal accommodating chamber to which a terminal is inserted;

a wire cover, configured to protect and guide a wire which is connected to the terminal inserted into the terminal accommodating chamber and is pulled out in a predetermined direction through a wire lead-out portion of the connector housing, and including a main body cover mounted on the connector housing and a lid cover combined with the main body cover so that the wire cover is mounted on the connector housing; and a cover mounting portion provided at a rear portion of the connector housing and having a circular or oval cross-section so as to surround the wire lead-out portion;

attachment portions, respectively provided in the main body cover and the lid cover, and formed in a cylinder shape surrounding the cover mounting portion in a state where the lid cover is combined with the main body cover, thereby mounting the wire cover on the connector housing, wherein one of the attachment portions provided in the main body cover is extended beyond a maximum diameter portion of the cover mounting portion in a direction perpendicular to an attachment direction in which the attachment portion is mounted on the cover mounting portion, the one of the attachment portions includes a provisional engagement portion provisionally engaged on the cover mounting portion at an end part of the one of the attachment portions, and configured to prevent the attachment portion from being detached from the cover mounting portion, and the main body cover includes a rotation restricting portion configured to come in contact with the connector housing to prevent a rotation of the main body cover when a rotational force is applied to the main body cover in a circumferential direction of the cover mounting portion in a state where the provisional engagement portion is provisionally engaged with the cover mounting portion.

The connector may be configured such that: the main body cover and the lid cover are rotatably connected at one end thereof to each other by a hinge, and the main body cover and the lid cover respectively include at the other end thereof lock portions configured to be locked each other when the lid cover is combined with the main body cover.

Advantageous Effects of Invention

According to the present invention, since the attachment portion of the main body cover is extended to a position beyond the maximum diameter of the cover mounting portion and the provisional engaging portion is provided for the cover mounting portion at the end of its extension, the main body cover can be prevented from being detached in a state of being provisionally attached to the connector housing. In addition, since the main body cover is provided with a rotation restricting portion which restricts the rotation of the main body cover by coming in contact with the connector housing, the main body cover may be held so as not to be rotated, even in the case where the rotational force is applied to the main body cover when the lid cover is combined with the main body cover. Therefore, there is no need to work with both hands in such a manner as the lid cover is combined with the main body cover with one hand while the main body cover is held with the other hand so as not to be rotated, the lid cover may be combined with the main body cover easily with one hand, and the wire cover may be mounted practically to the connector housing.

According to the present invention, the lid cover first pivots from the hinge toward the main body cover which is provisionally mounted so that the main body cover and the locking portion of the lid cover may be locked each other, thereby the main body cover and the lid cover may be combined with each other and it is possible to mount the wire cover on the connector housing in that state.

According to the present invention, the main body cover may be prevented from being detached from the connector housing in a state of having been attached provisionally to the connector housing. In addition, the main body cover may be kept so as not to be rotated even in the case where the rotational force is applied to the main body cover when the lid cover is combined with the main body cover. Thus, it is possible to combine the lid cover with the main body cover easily with one hand only and to mount the wire cover to the connector housing, thereby improving the workability.

DESCRIPTION OF EMBODIMENTS

Applicant has considered a connector provided with a wire cover as shown in FIGS. 13 to 19.

Figure 13:
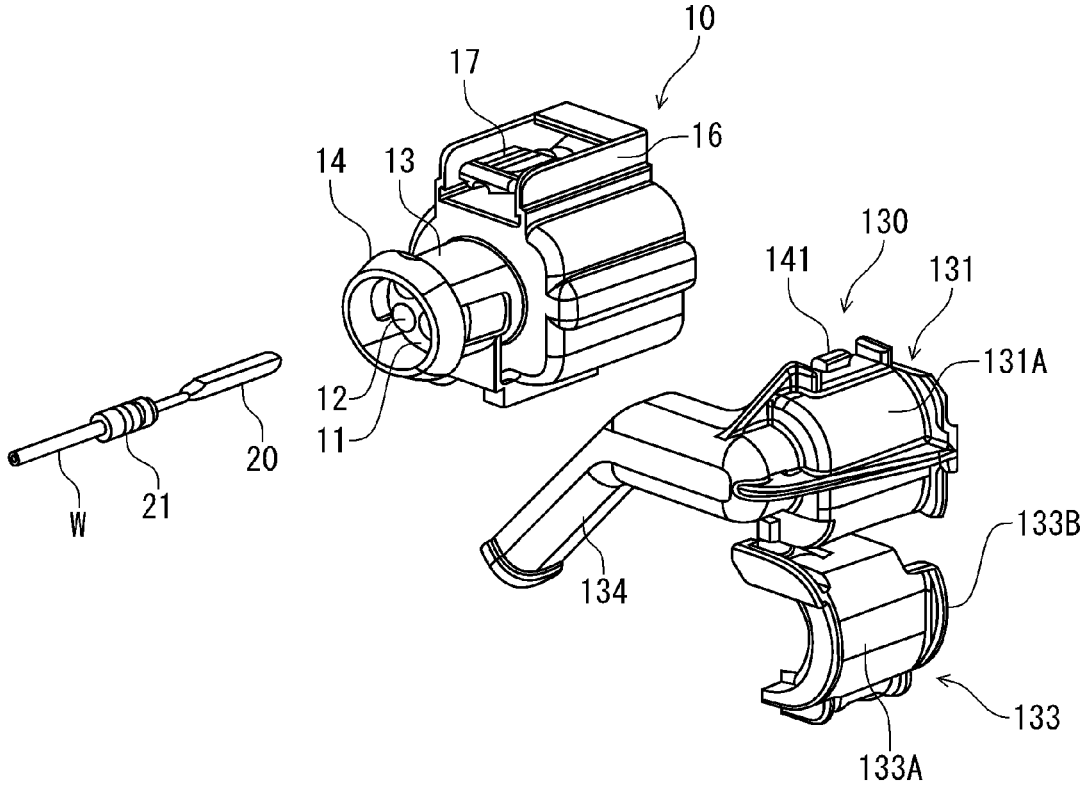
FIG. 13 is an exploded perspective view of the connector cover with the wire cover according to a related art.
Figure 14:
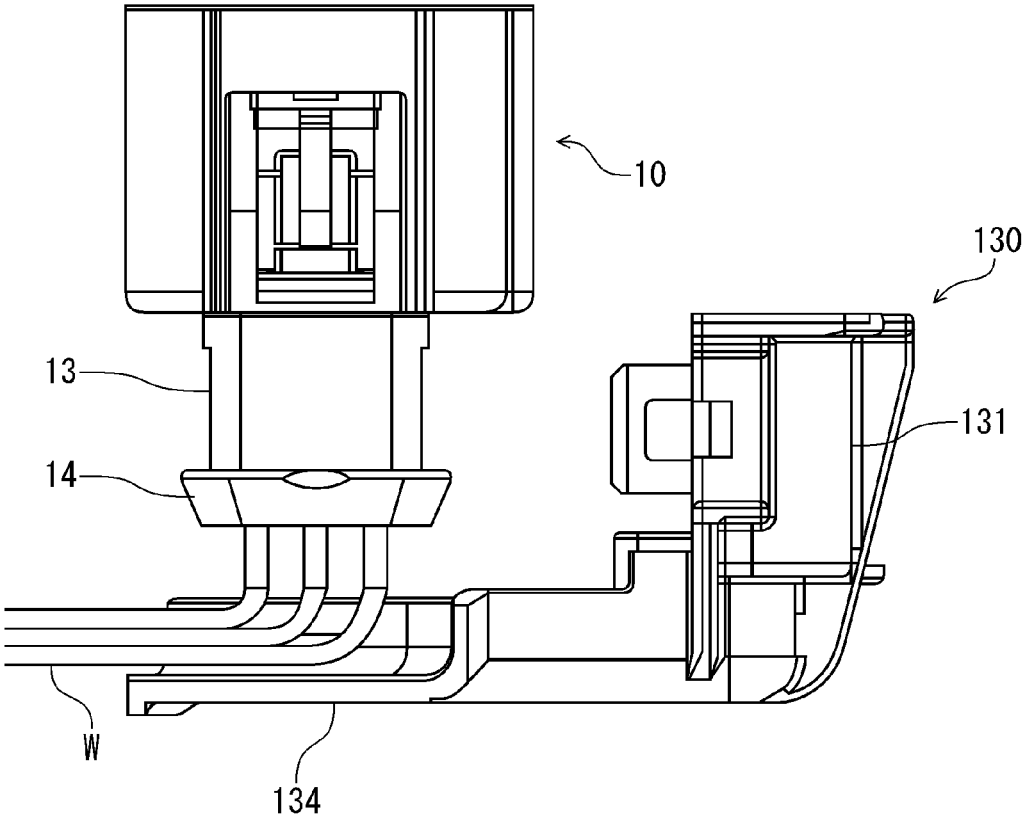
FIG. 14 is a diagram showing a state in the middle of assembling the connector with the same wire cover, and a plan view showing a state that is trying to mount the wire cover to the rear portion of the connector housing.
Figure 15:
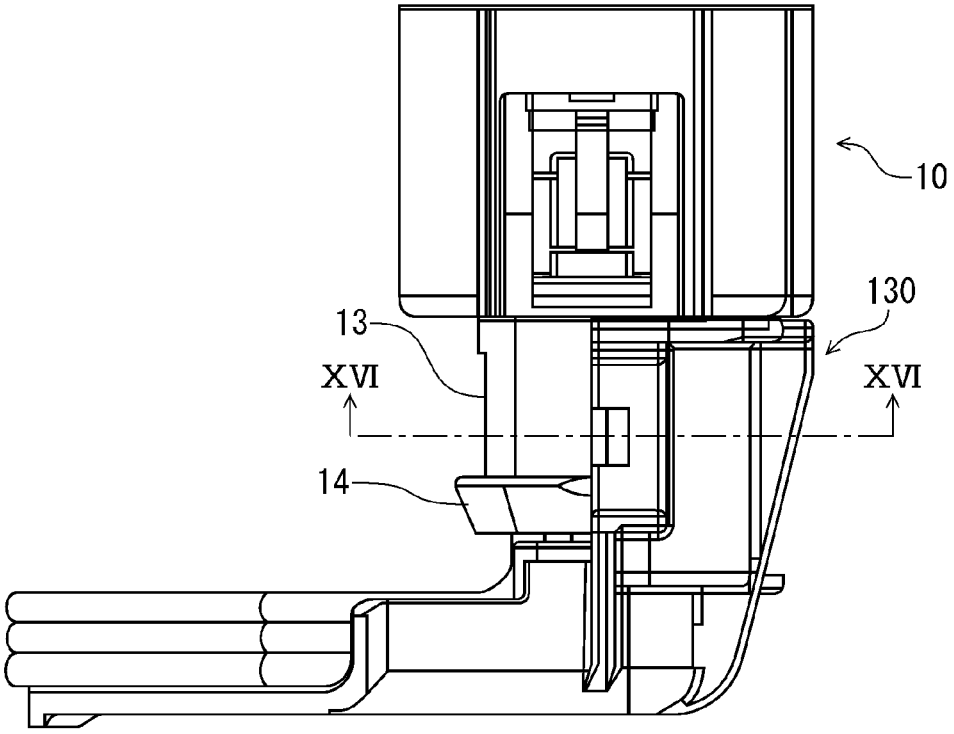
FIG. 15 is a plan view showing a state in which the main body cover as one piece divided from the wire cover is attached provisionally to the mounting portion of the same connector housing.
Figure 16:
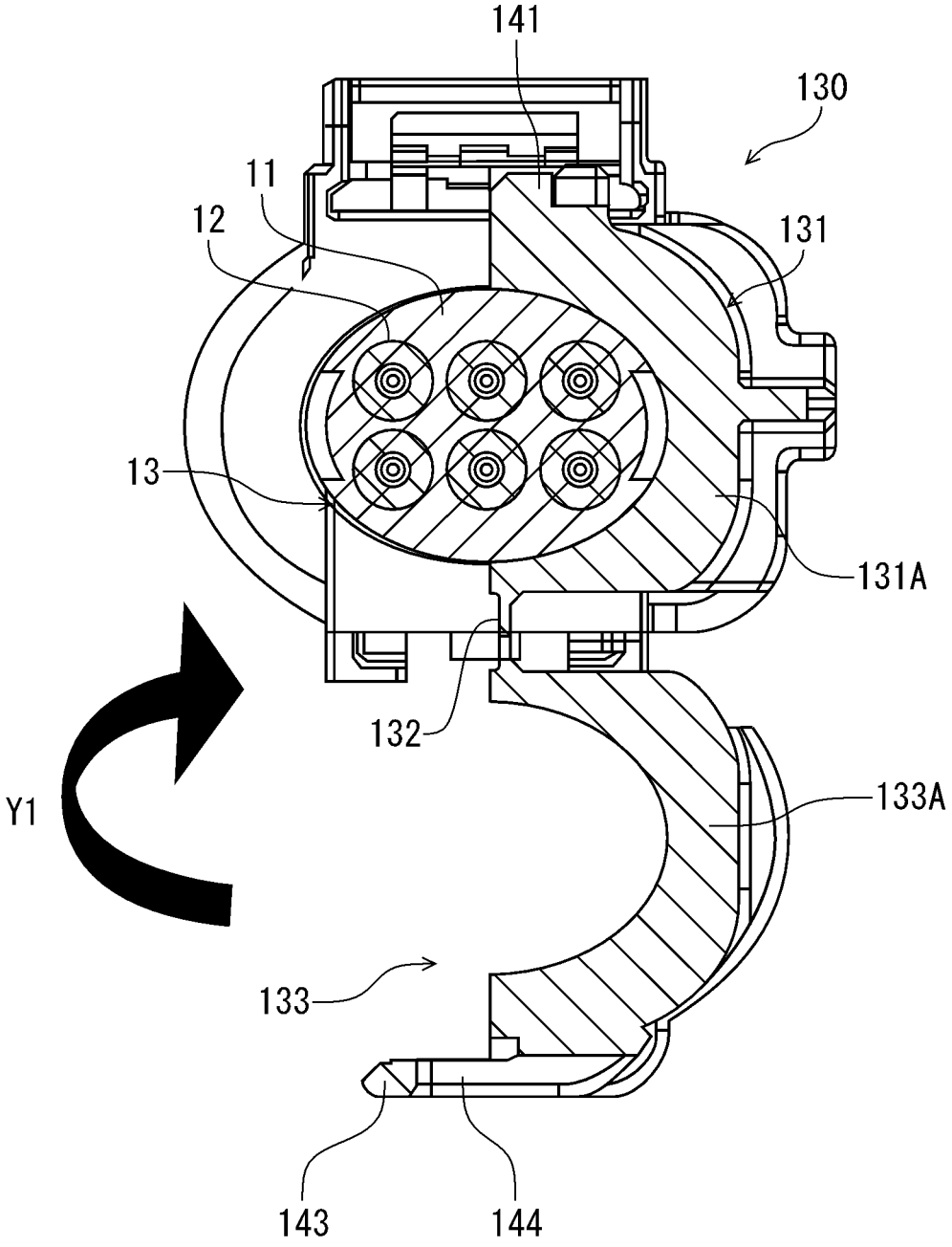
FIG. 16 is a cross-sectional view taken along arrow XVI-XVI of FIG. 15.
Figure 17:
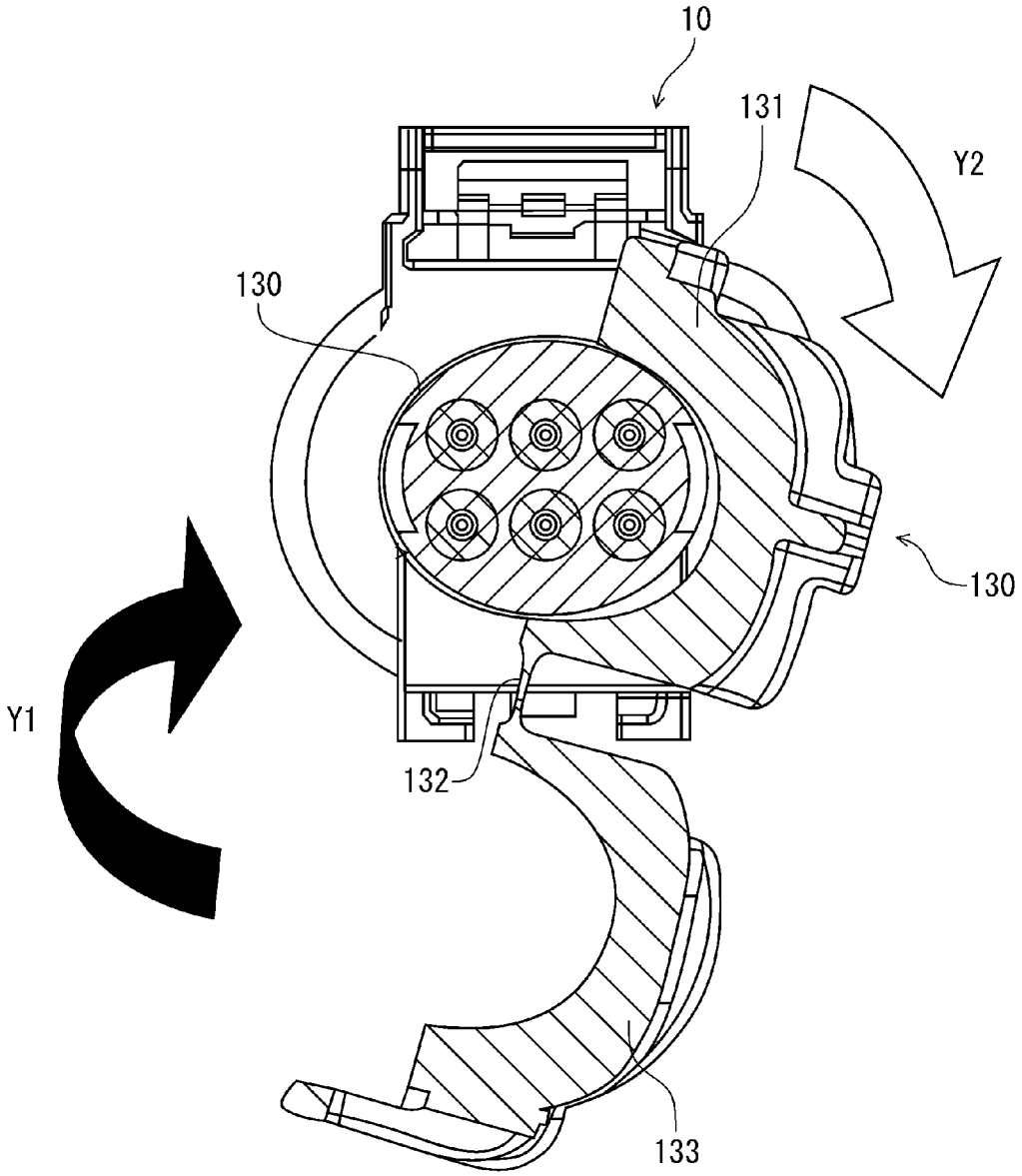
FIG. 17 is the same cross-sectional view as in FIG. 16 for illustrating a problem that the main body cover rotates from the normal position thereof when the lid cover rotates from the states in FIGS. 15 and 16.
Figure 18:
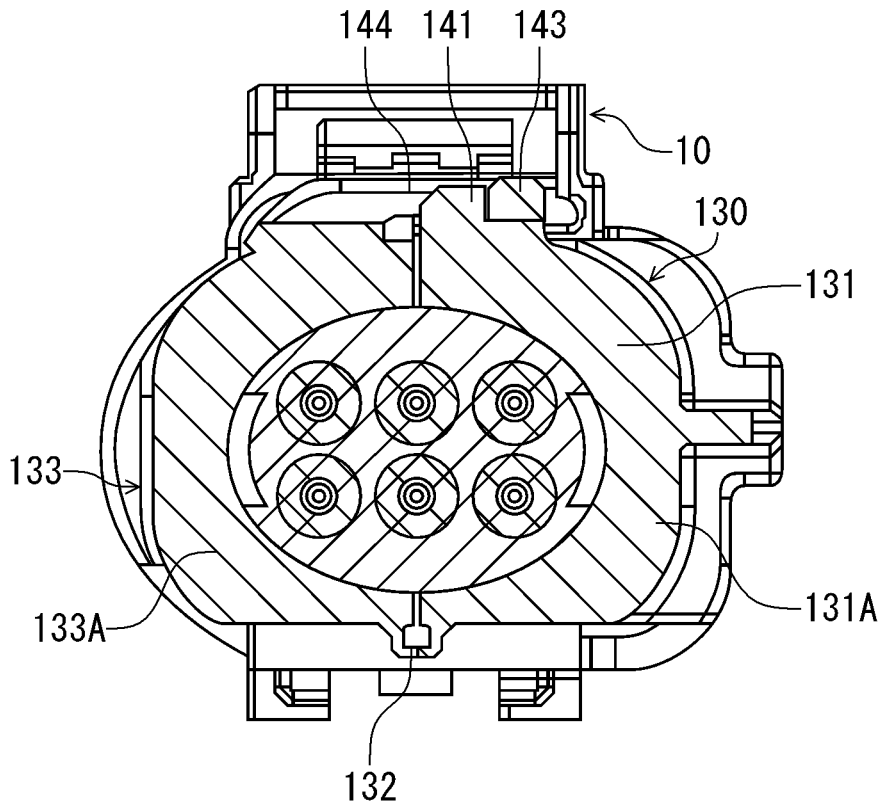
FIG. 18 is the same cross-sectional view as in FIG. 16 showing the state in which the wire cover is mounted to the connector housing by combining and locking the main body cover and the lid cover together.
Figure 19:
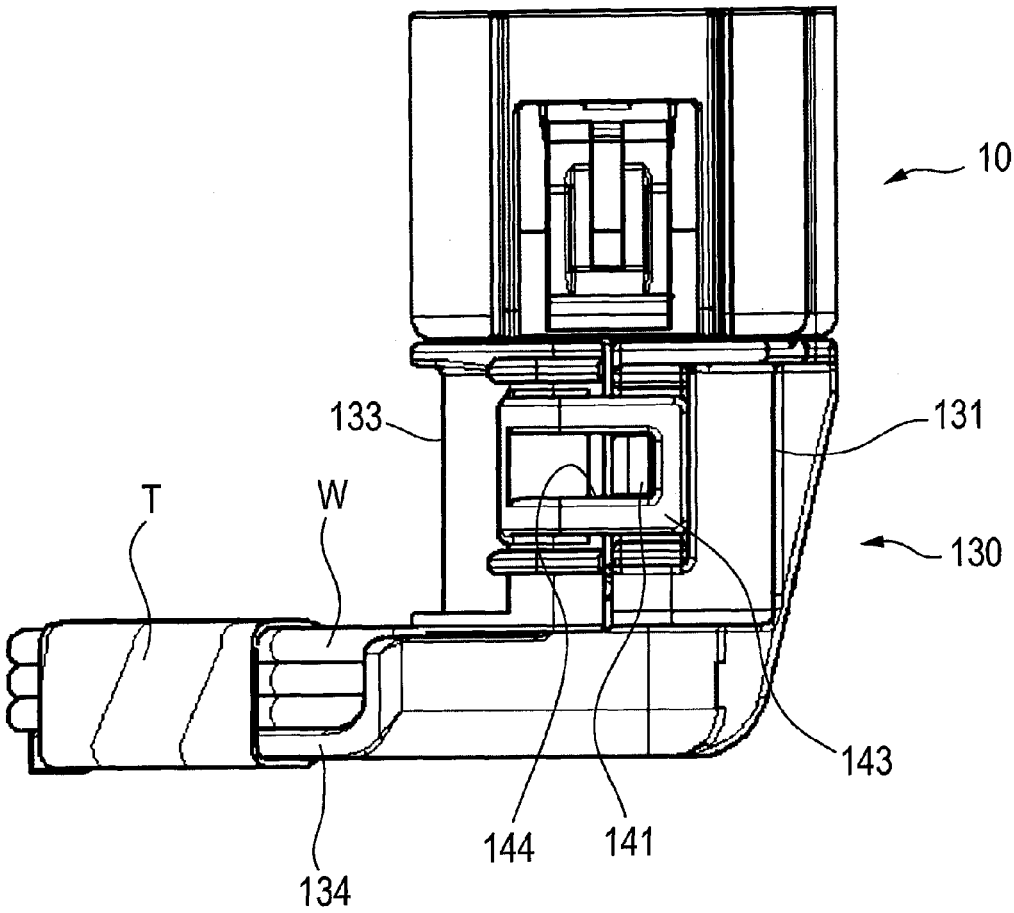
FIG. 19 is a plan view showing a state in which a wire harness is formed by winding a tape around the electric wire in the wire cover.

FIG. 13 is an exploded perspective view showing a connector provided with a wire cover according to the related art. FIG. 14 is a view showing a state during assembling of the connector having the same wire cover and at the same time a plan view showing a state where the wire cover is to be mounted on the rear portion of the connector housing. FIG. 15 is a plan view showing a state where a main body cover as one portion of the divided wire cover is temporally mounted on a cover mounting portion of the connector housing. FIG. 16 is a cross sectional view taken along the arrow line XVI-XVI shown in FIG. 15. FIG. 17 is the same view as in FIG. 16 for illustrating the problem that the main body cover is rotated beyond a normal position when the lid cover is rotated under the state shown in FIGS. 15 and 16. FIG. 18 is the same cross sectional view as in FIG. 16 for showing the state where the wire cover is mounted on the connector housing by assembling and locking the lid cover and the main body cover together. FIG. 19 is a plan view showing a state where a wire harness is constructed by winding a tape around electric wires of the wire cover.

As shown in FIG. 13, the connector provided with the wire cover includes a connector housing 10 formed of a molded resin, a plurality of terminals 20 connected to electric wire W to which a cylinder shaped packing member 21, and a wire cover 130 formed of a molded resin which is mounted on a rear portion of the connector housing 10.

The connector housing 10 is provided at the rear portion thereof with a wire lead-out portion 11 is provided on the rear portion of the connector housing 10, an inlet of the plurality of terminal accommodating chambers 12 is open at the rear surface of the wire lead-out portion 11. Then, in the structure thereof, the terminal 20 attached to the terminal of electric wire W may be inserted from each inlet to the inside of the terminal accommodating chamber 12. Further, when the terminal 20 is inserted in such a manner, the packing member 21 that is in advance attached to the outer circumference of the wire W seals the gap between the electric wire W and the inner peripheral wall of the terminal accommodating chamber 12. When the terminal 20 is inserted into the respective terminal accommodating chambers 12 of the connector housing 10, the wire W which is connected to the terminal 20 is pulled out toward the rear side of the wire lead-out portion 11. Then, in order to guide and derive the wire W in a predetermined direction while protecting the wire W, the wire cover 130 is mounted to the rear portion of the connector housing 10.

In order to mount the wire cover 130, the connector housing 10 is provided at its rear portion with the cover mounting portion 13 having an elliptical cross section (which may be circular) so as to surround the wire lead-out portion 11. The cover mounting portion 13 is provided at the end portion thereof with the annular convex portion 14 with larger diameter than the cover mounting portion 13. Further, the upper surface of the connector housing 10 is provided with a lock arm 17 to be locked when engaged with a mating connector housing, and a lock arm protecting frame 16.

On the other hand, the wire cover 130 is divided into two portions which are a main body cover 131 and a lid cover 133. The main body cover 131 is first mounted to the rear portion of the connector housing, and the lid cover 133 is combined with the main body cover 131 at the rear side thereof thereby allowing the wire cover 130 to be mounted actually to the connector housing 10. The main body cover 131 and lid cover 133, as shown in FIG. 16, are connected rotatably by a hinge 132 (i.e., openable) to each other at each of the ends thereof. The main body cover 131 and the lid cover 133 are provided with the respective semi-cylindrical mounting portions 131A, 133A which are formed into a cylindrical shape when the main body cover 131 and the lid cover 133 are combined with each other, thereby allowing the cover mounting portion 13 of the connector housing 10 to be inserted therein and accordingly allowing the wire cover 130 to be mounted in the connector housing 10. In addition, the main body cover 131 is provided with a wire guide portion 134 which serves to bend and guide in an orthogonal direction a wire W pulled out from the rear portion of the connector housing 10 and at the same time, which is wound by the tape T together with the wire W (see FIG. 19).

Further, the locking projection 141 is provided at an end portion opposite the hinge 132 of the main body cover 131, and the lock arm 143 having a lock hole 144 into which the locking projection 141 is inserted at the end portion opposite the hinge 132 of the lid cover 133. When the lid cover 133 is combined with the main body cover 131, as shown in FIG. 18, the lock arm 143 is engaged with the locking projection 141, the lid cover 133 and the main body cover 131 are held in the combined state, and the cover mounting portion 13 of the connector housing 10 is sandwiched between the mounting portion 131A of the main body cover 131 and the mounting portion 133A of the lid cover 133, thereby the wire cover 130 is mounted in the connector housing 10.

When the connector provided with the wire cover is assembled, first, the terminal 20 connected to the terminal of wire W is inserted into each of the terminal accommodating chambers 12 of the connector housing 10 from the inlet of the rear end. When the connector has been assembled by completely inserting the terminals 20, as shown in FIGS. 14 to 17, the mounting portion 131A of the main body cover 131 is provisionally mounted to the cover mounting portion 13 of the rear portion of the connector housing 10 while the wire W pulled out from the rear portion of the connector housing 10 toward the rear side thereof is bent in a direction of being guided by the wire cover 130.

Next, in this state, the lid cover 133 is rotated as indicated by arrow Y1 shown in FIG. 16 so that the lid cover 133 is combined with the main body cover 131 as shown in FIG. 18, thereby the locking projection 141 are locked each other. Then, finally, by winding the tape T around the wire guide portion 134, which is formed integrally with the main body cover 131, the wire W is thereby fixed by the tape T in the state where the wire W is bent, thereby the assembly of the connector having the wire cover is completed.

In the case of practically assembling the connector, however, when the lid cover 133 is combined with the main body cover 131 which is provisionally attached to the connector housing 10, there is a possibility that the main body cover 131 rotates with the rotation of the lid cover 133 as shown by the arrow Y2 in FIG. 17 because the cross section of the cover mounting portion 13 of the connector housing 10 is elliptically shaped. For that reason, the lid cover 133 should be adjusted to the man body cover 131 by one hand while the cover body 131 is held by the other hand so as to prevent the main body cover 131 from being rotated, i.e., since it is necessary to work with both hands, it has been known that its workability is poor.

According to the present invention, there is to provide a connector provided with a wire cover that can be attached to a connector housing easily with one hand thereby providing good workability in assembly.

Hereinafter, embodiments of the present invention will be described with reference to the accompanying drawings.

Figure 1:
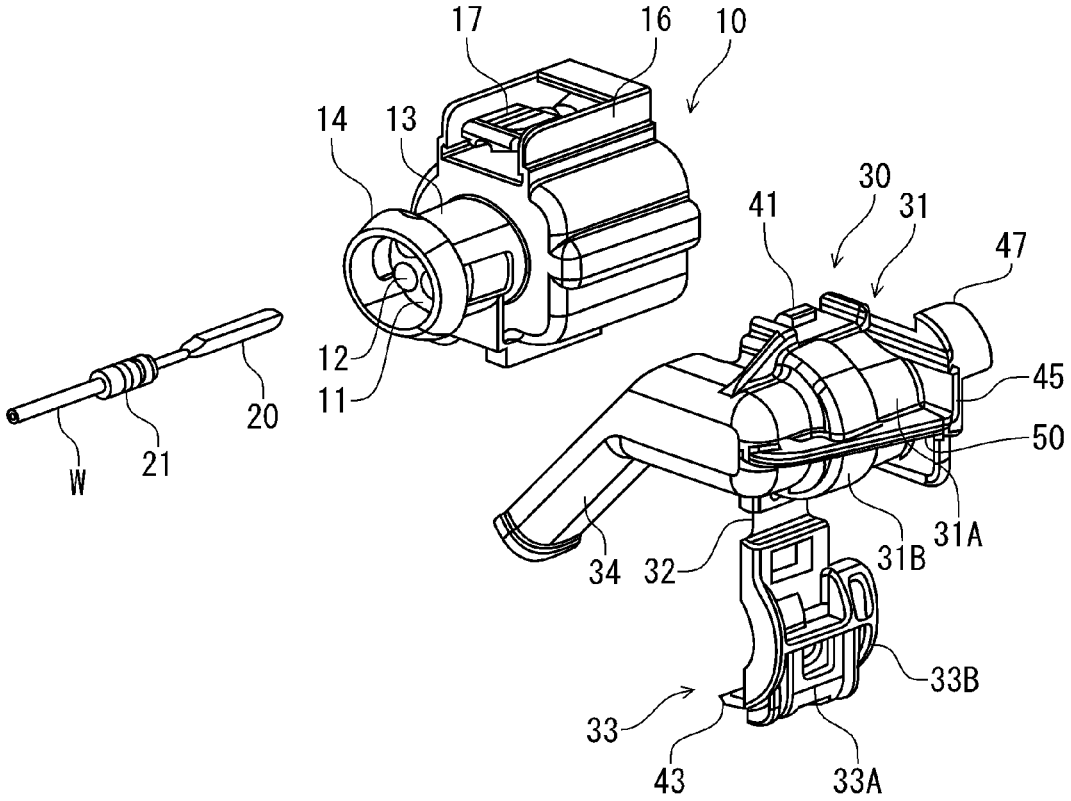
FIG. 1 is an exploded perspective view showing a connector with a wire cover according to one embodiment of the present invention.
Figure 2:
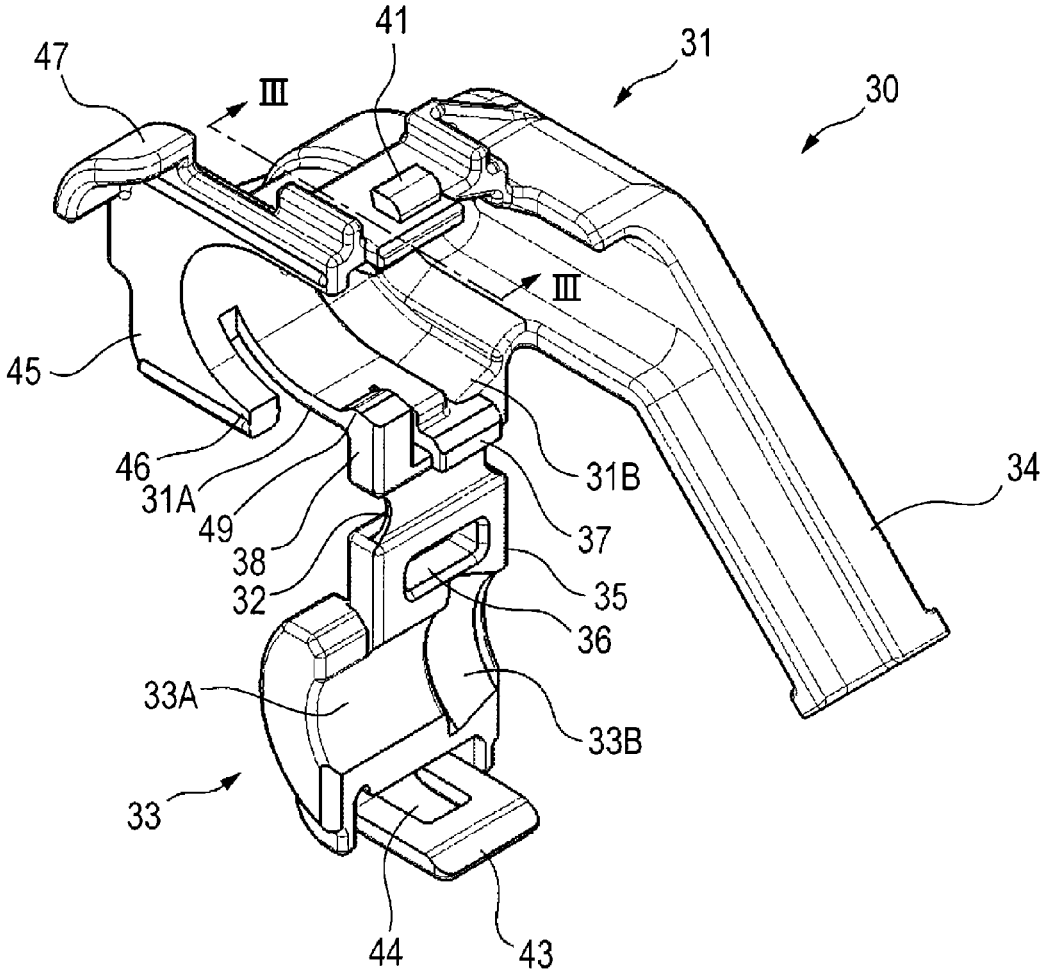
FIG. 2 is a perspective view as seen from the front side of the wire cover used in the connector.
Figure 3:
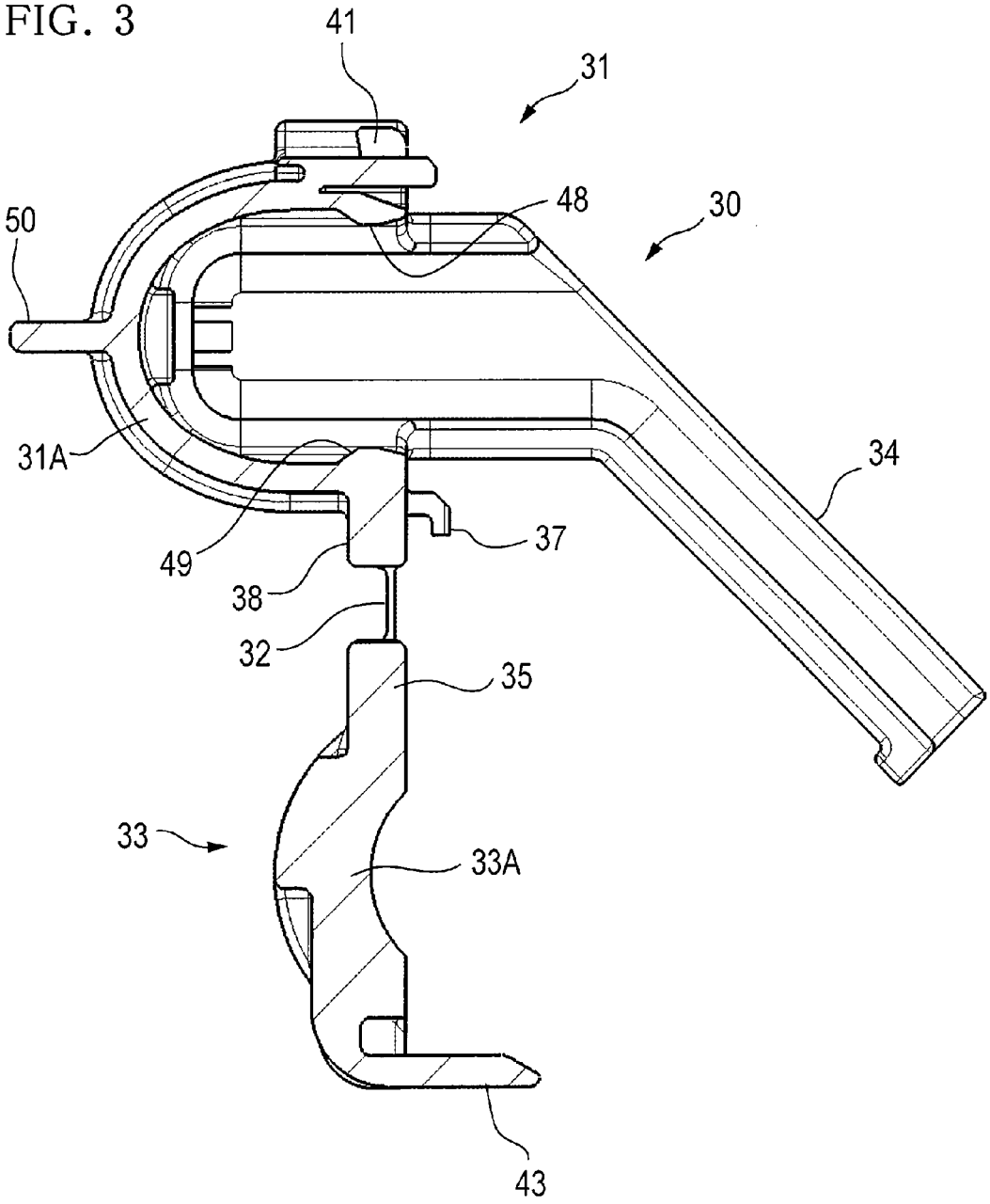
FIG. 3 is a cross-sectional view taken along arrow III-III of FIG. 2.
Figure 4:
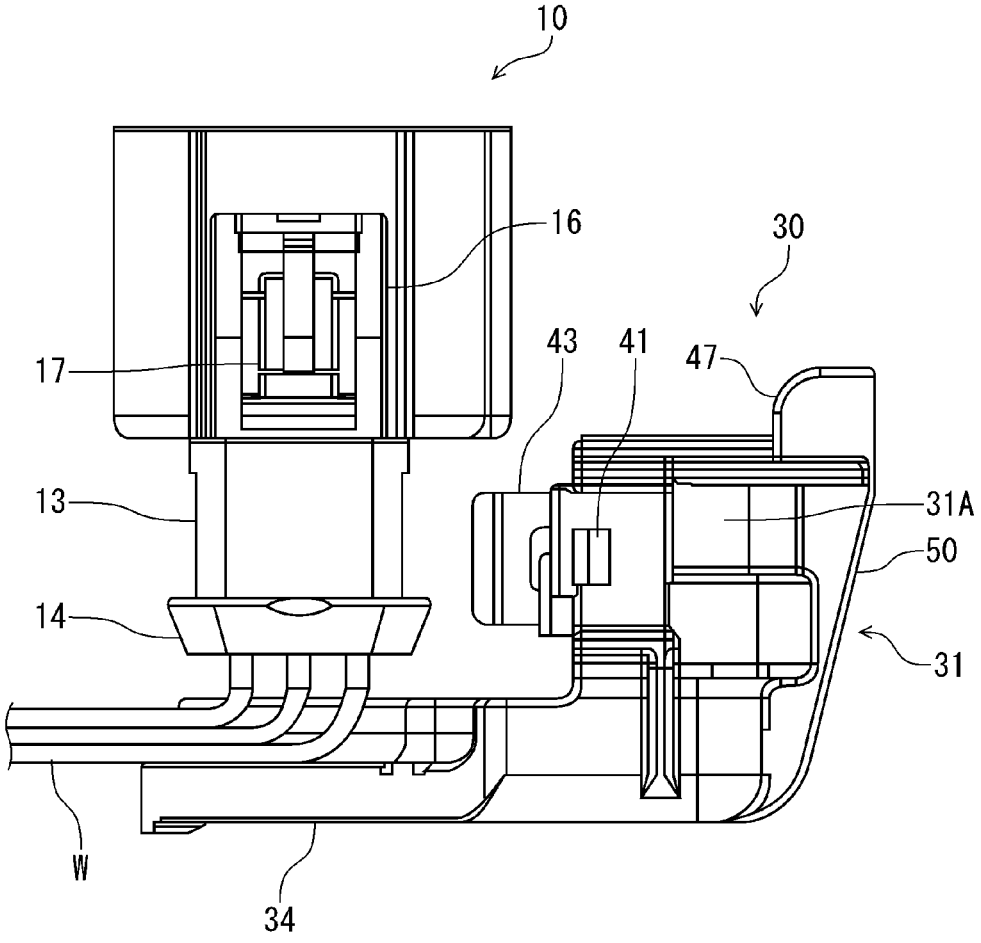
FIG. 4 is a plan view showing a state in the middle of assembling of the connector with the wire cover.
Figure 5:
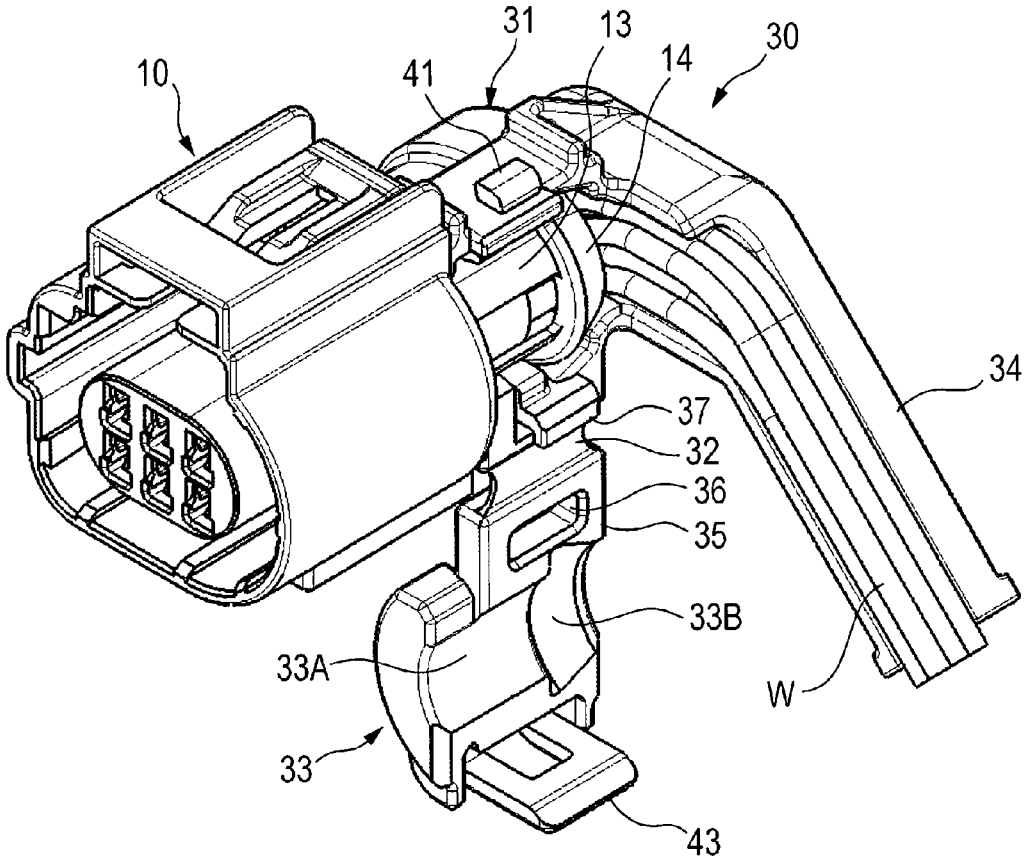
FIG. 5 is a perspective view, as seen from the front side, illustrating a state in which the main body cover as one piece divided from the wire cover is attached provisionally to the cover mounting portion of the connector housing.
Figure 6:
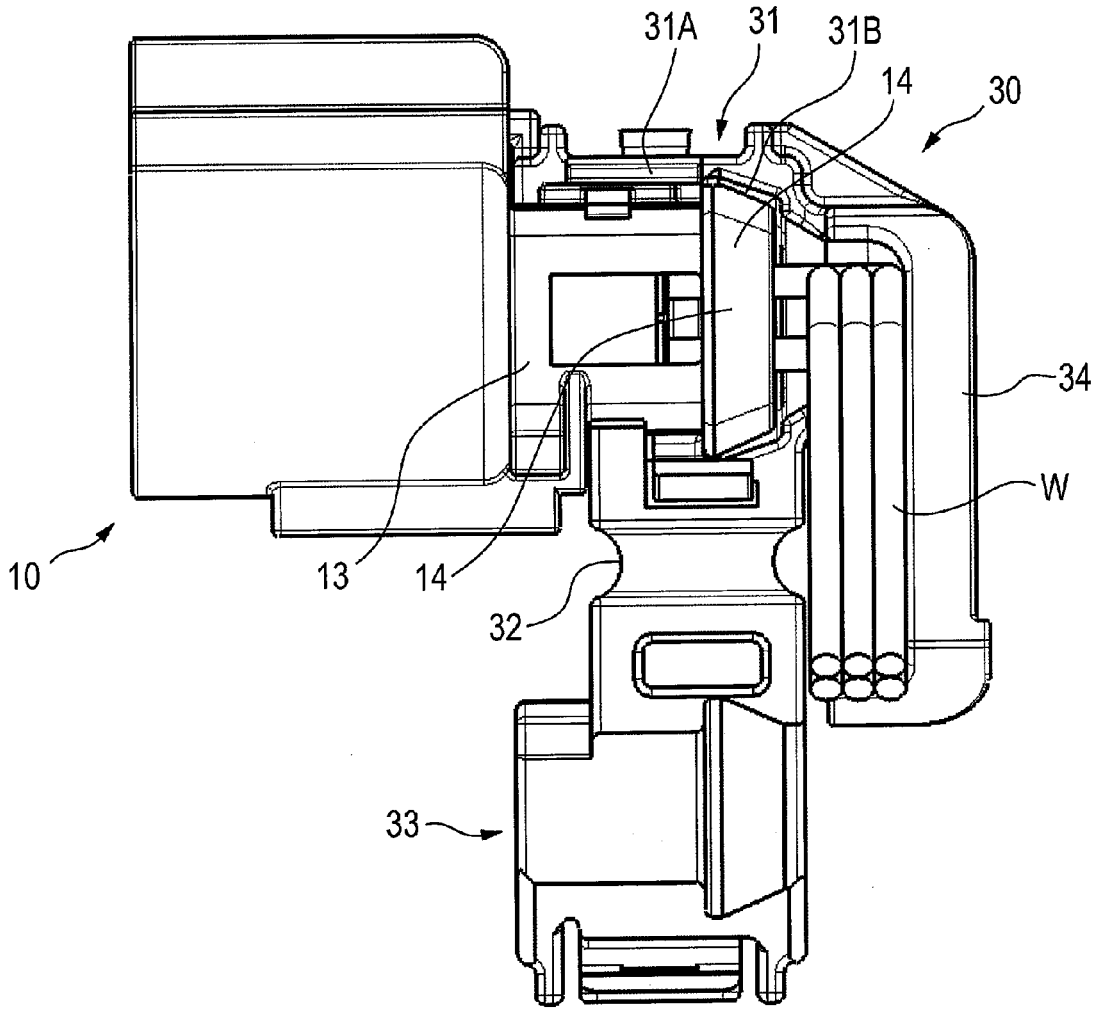
FIG. 6 is a side view showing the same state as in FIG. 5 as seen from the side thereof.
Figure 7:
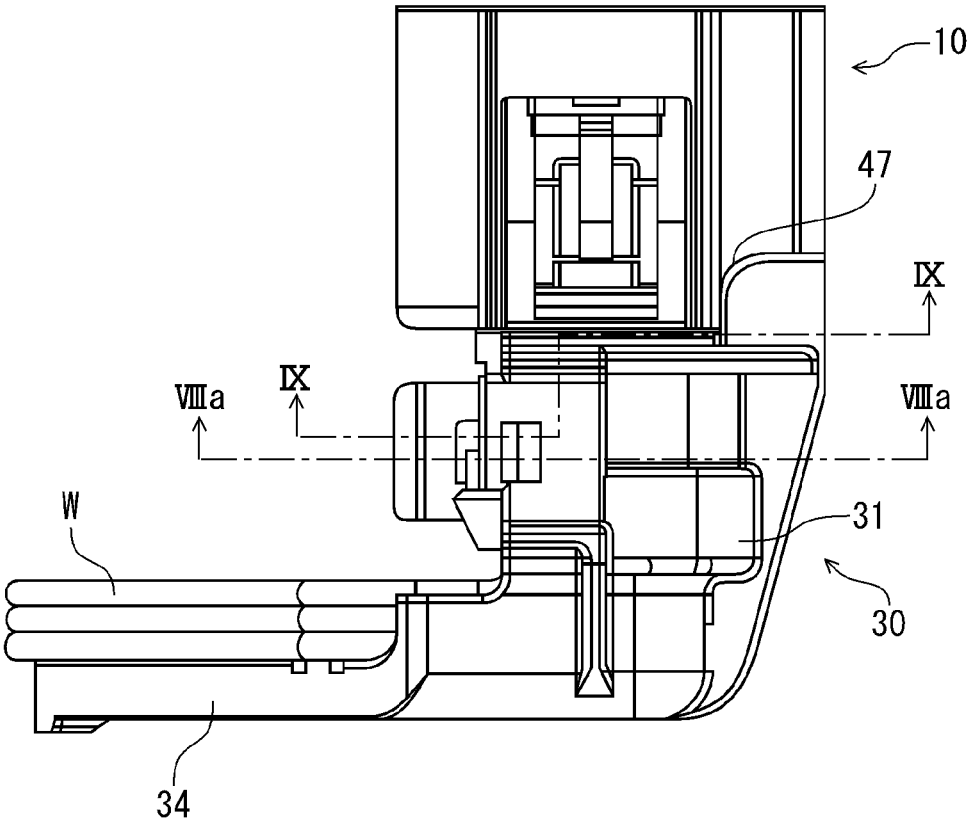
FIG. 7 is a plan view showing the same state as in FIG. 5 as seen from the top side.
Figure 8:
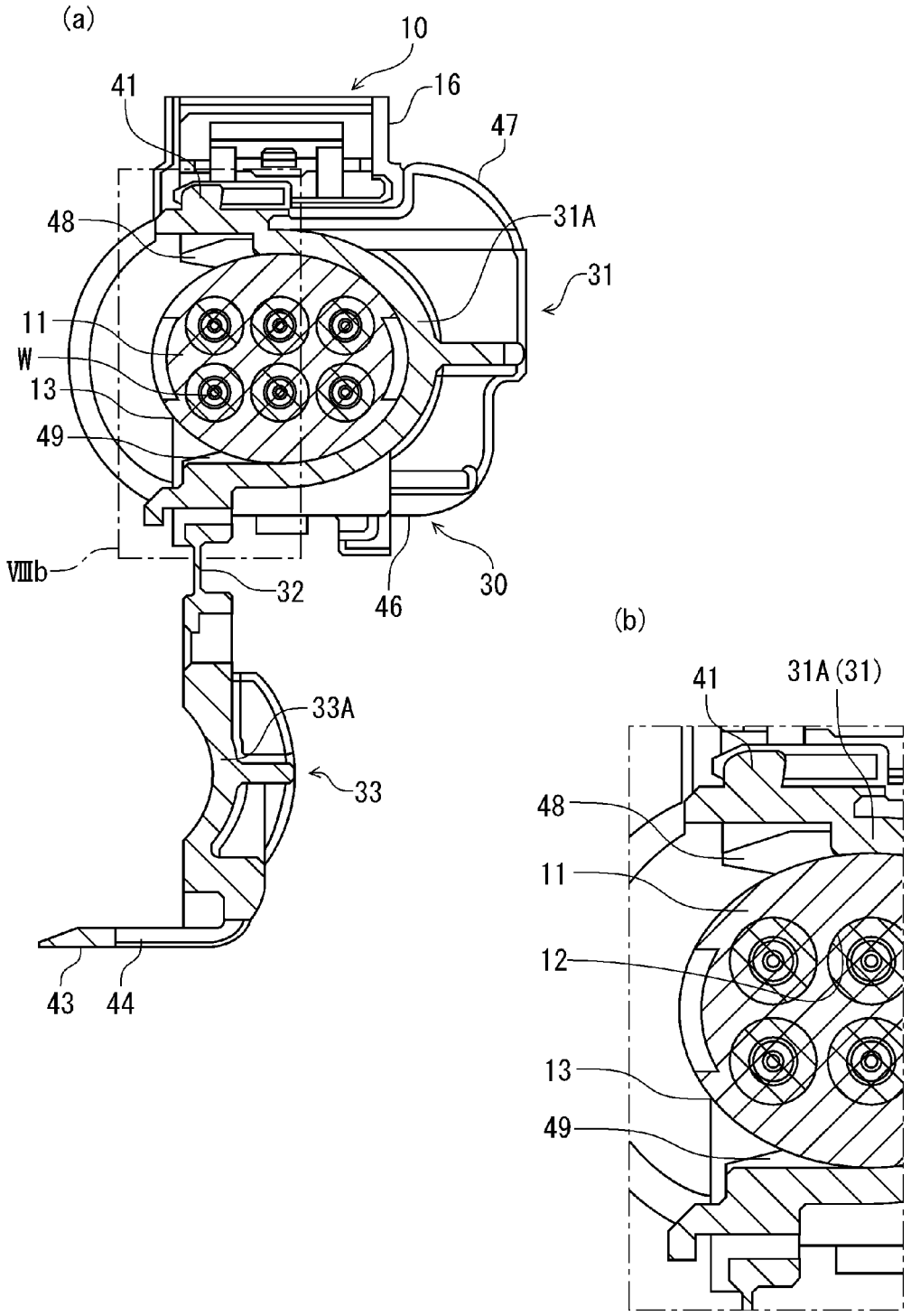
FIG. 8(*a*) is a sectional view taken along line VIIIa-VIIIa of FIG. 7, and FIG. 8(*b*) is an enlarged view of the part VIIIb of FIG. 8(*a*).
Figure 9:
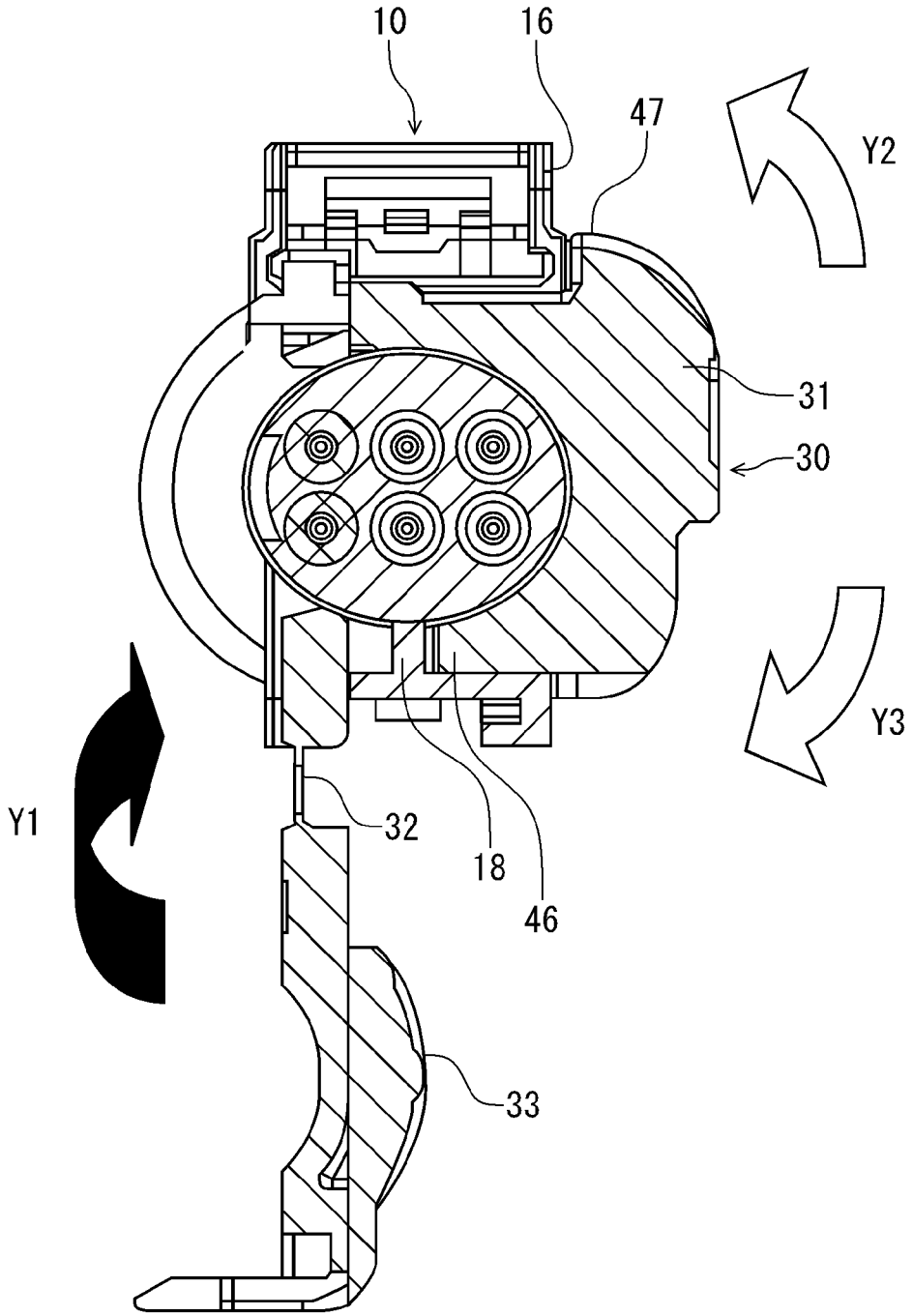
FIG. 9 is a cross-sectional view taken along arrow IX-IX in FIG. 7.
Figure 10:
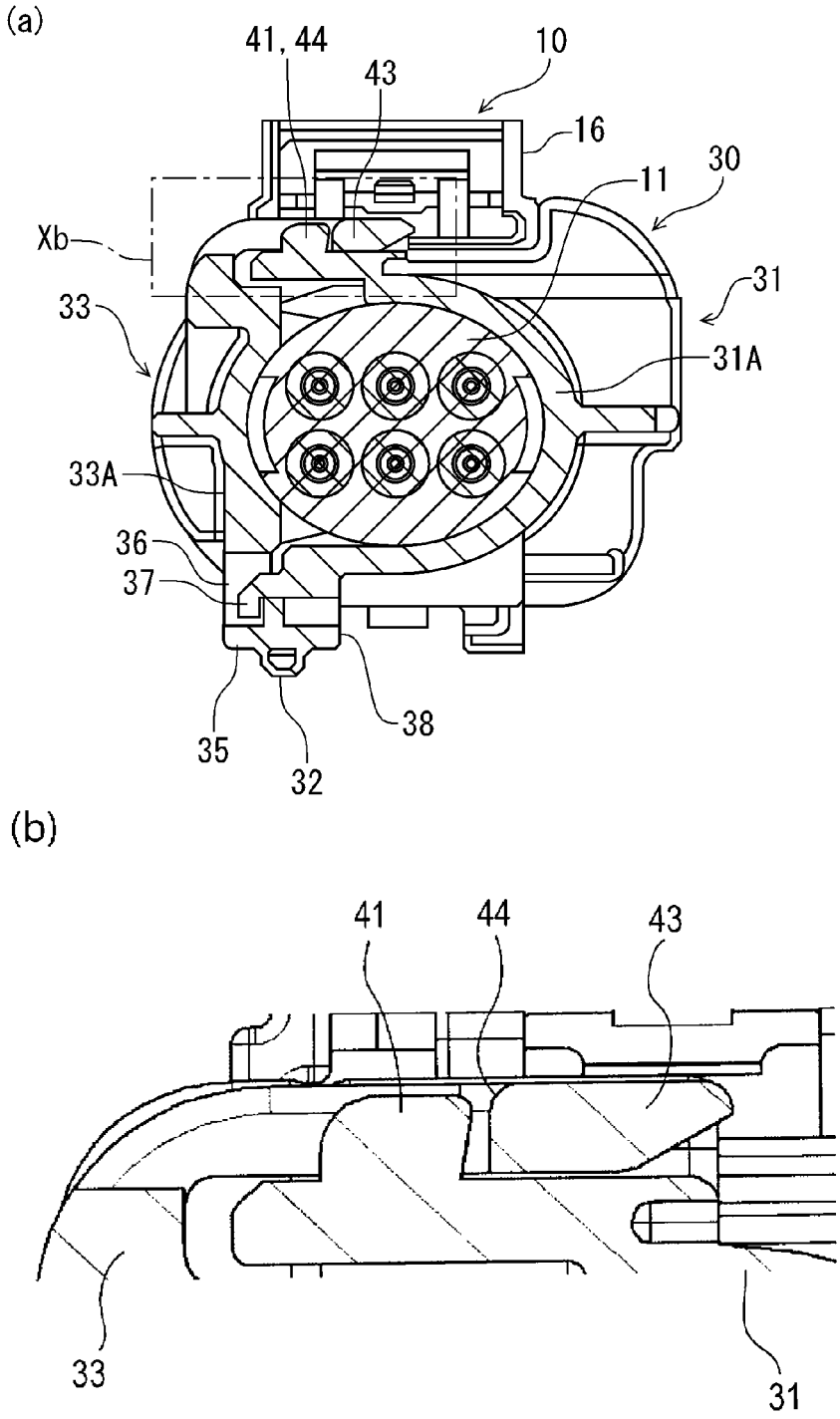
FIG. 10(*a*) is the same cross-sectional view as in FIG. 9 showing a state in which the wire cover is practically mounted to the connector housing by combining the lid cover with the main body cover to lock each other, and FIG. 10(*b*) is an enlarged view of the part Xb of FIG. 10(*a*).
Figure 11:
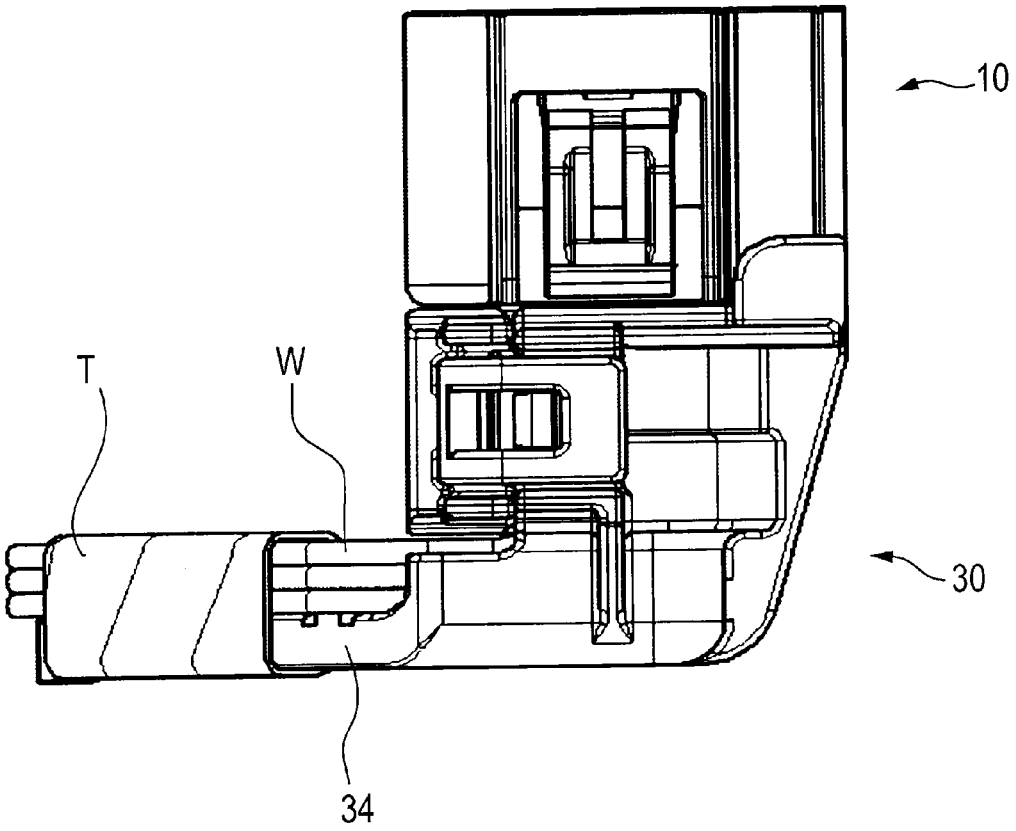
FIG. 11 is a plan view showing a state in which a wire harness is formed by winding a tape around the electric wire together with the wire cover.
Figure 12:
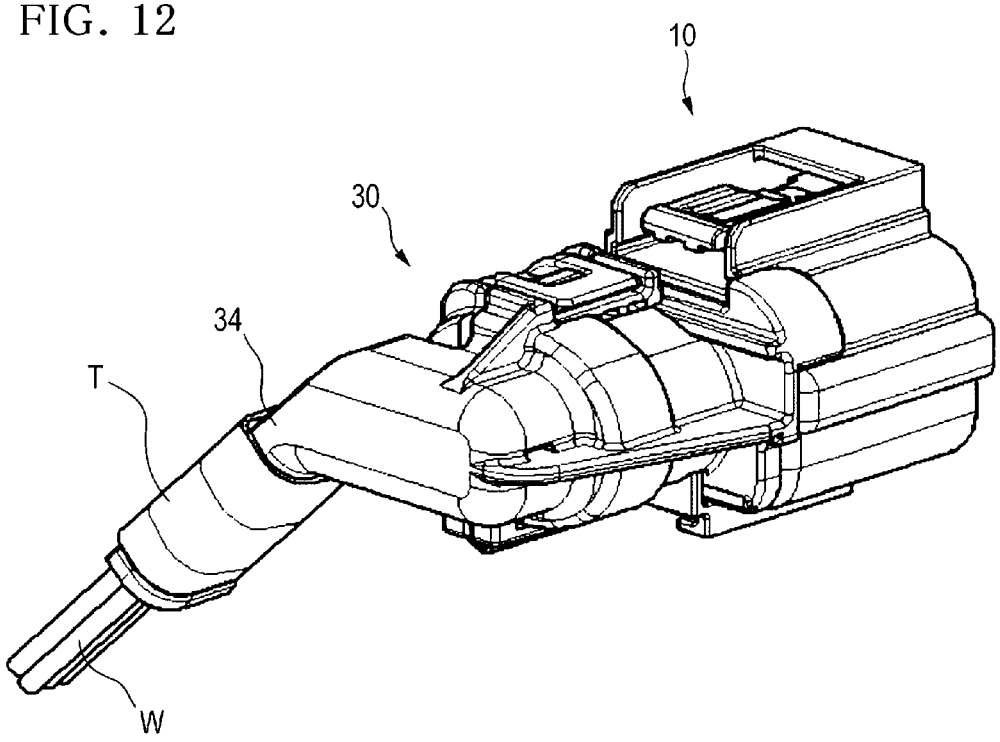
FIG. 12 is a perspective view showing a state in which a wire harness is formed by winding a tape around the electric wire together with the wire cover.

FIG. 1 is an exploded perspective view showing a connector with a wire cover according to one embodiment of the present invention. FIG. 2 is a perspective view as seen from the front side of the wire cover used in the connector provided with the wire cover. FIG. 3 is a cross-sectional view taken along the arrow line III-III of FIG. 2. FIG. 4 is a diagram showing a state in the middle of assembling of the connector with the wire cover and at the same time a plan view showing a state that is trying to mount the wire cover to a rear portion of the connector housing. FIG. 5 is a perspective view, as seen from the front side, illustrating a state where the main body cover as one piece divided from the wire cover is provisionally attached to the cover mounting portion of the connector housing. FIG. 6 is a side view showing the same state as in FIG. 5 as seen from the side thereof. FIG. 7 is a plan view showing the same state as in FIG. 5 as seen from the top side. FIG. 8(*a*) is a sectional view taken along the arrow line VIIIa-VIIIa of FIG. 7, and FIG. 8(*b*) is an enlarged view of the part VIIIb of FIG. 8(*a*). FIG. 9 is a cross-sectional view taken along the arrow line IX-IX in FIG. 7. FIG. 10(*a*) is the same cross-sectional view as in FIG. 9 showing a state in which the wire cover is actually mounted to the connector housing by combining the lid cover with the main body cover to lock each other, and FIG. 10(*b*) is an enlarged view of the part Xb of FIG. 10(*a*). FIG. 11 is a plan view showing a state in which a wire harness is formed by winding a tape around the electric wire together with the wire cover. FIG. 12 is a perspective view showing a state in which a wire harness is formed by winding a tape around the electric wire together with the wire cover.

As shown in FIG. 1, the connector with the wire cover includes a connector housing 10 formed of a resin-molded product, a plurality of terminals 20 which is connected to a end of the wire W to which a cylinder shaped packing member 21 is attached, and a wire cover 30 which is formed of a resin-molded product and attached to a rear portion of the connector housing 10.

A wire lead-out portion 11 is provided on the rear portion of the connector housing 10, and an inlet of a plurality of terminal accommodating chambers 12 is open on a rear surface of the wire lead-out portion 11. Then, the terminal 20 attached to the end of the wire W may be inserted into the inside of the terminal accommodating chamber 12 from each of the inlet thereof. Also, when the terminal 20 is inserted in such a manner, the cylinder shaped packing member 21 which is mounted on the outer circumference of the wire W in advance serves to seal the gap between the wire W and an inner peripheral wall of the terminal accommodating chamber 12. When the terminal 20 is inserted into each of the terminal accommodating chambers 12 of the connector housing 10, the wire W which is connected to the terminal 20 is pulled out in the rear direction from the wire lead-out portion 11. Then, the wire cover 30 is mounted on the rear portion of the connector housing 10 for the purpose of guiding and pulling out these wires W in a predetermined direction while protecting these wires.

In order for the wire cover 30 to be mounted, the cylinder shaped cover mounting portion 13 with an oval shaped cross section having a long axis in the horizontal direction (lateral direction) and a short axis in the vertical direction (longitudinal direction) is provided on the rear portion of the connector housing 10 so as to surround the wire lead-out portion 11. The cover mounting portion 13 may have a circular cross section. The cover mounting portion 13 is provided at the end portion thereof with an annular convex portion 14 with a larger diameter than that of the cover mounting portion 13. Further, the connector housing 10 is provided on the upper surface thereof with a lock arm 17 and a lock arm protecting frame 16 to be locked together when engaged with a mating connector housing.

On the other hand, as shown in FIGS. 2 to 10, the wire cover 30 is divided into two portions as a main body cover 31 which is first mounted to the rear portion of the connector housing 10 and a lid cover 33 which is combined with the main body cover 31 from the rear side thereof so that the wire cover 30 is mounted to the connector housing 10.

The main body cover 31 and the lid cover 33 are rotatably connected at the ends thereof to each other by a hinge 32, so that the main body cover 31 and the lid cover are openably connected to each other.

The main body cover 31 and the lid cover 33 are provided with attachment portions 31A, 33A, respectively, which are formed in a cylinder shape when the main body cover 31 and the lid cover 33 are combined with each other, so that the cover mounting portion 13 of the connector housing 10 is surrounded by the attachment portions 31A, 33A and the wire cover 30 is thereby mounted to the connector housing 10. The attachment portions 31A, 33A are provided at its ends thereof with fitting walls 38, 35, respectively, which are connected to each other by a hinge 32.

When the main body cover 31 and the lid cover 33 are combined with each other, as shown in FIG. 10, the fitting walls 38, 35 are met each other at surfaces thereof. An engagement hook 37 and an engagement hole 36, which are provided on the fitting walls 38, 35, are engaged with each other when the main body cover 31 and the lid cover 33 are combined with each other, thereby reinforcing the connection of the attachment portions 31A, 33A at the end thereof by the hinge 32.

In this case, the attachment portion 31A of the main body cover 31 and the attachment portion 33A of the lid cover 33 are formed not by dividing in half a cylindrical body surrounding the cover mounting portion 13 with an oval-shaped cross section, but rather dividing them at a ratio that the attachment portion 31A of the main body cover 31 becomes larger than the attachment portion 33A of the lid cover 33.

That is, the attachment portion 31A of the main body cover 31 is formed with a C-shaped cross section, 31A mounting portion of the cover body 31, both of the ends thereof are extended to a position beyond the maximum diameter portion of the cover mounting portion 13 in a direction (longitudinal direction) that is perpendicular to the direction (lateral direction) that the attachment portion 31A is mounted on the cover mounting portion 13. The maximum diameter portion has the largest dimension in a direction of the short axis of the cover mounting portion with an oval cross section. The attachment portion 33A of the lid cover 33 becomes shortened by the amount that the attachment portion 31A of the main body cover 31 is extended longer.

Then, as indicated in FIG. 8, the attachment portion 31A of the main body cover 31 is provided at the upper and lower extended ends thereof with provisional engagement portions 48, 49 which are provisionally elastically engaged with the outer periphery of the cover mounting portion 13 thereby preventing the attachment portion 31A from being detached from the cover mounting portion 13. Here, the provisional engagement portion 48 at the upper side is made of a flexible locking arm.

As shown in FIG. 9, the main body cover 31 with a C-shaped cross section is provided with rotation restricting portions 46, 47 that collide with the lock arm protecting frame 16 positioned at a upper side or with the rib 18 at a lower side of the connector housing 10 when the rotational force is applied to the main body cover 31 in such a direction as arrow Y3 or arrow Y2 along the circumferential direction of the cover mounting portion 13 in a state where the provisional engagement portions 48, 49 are provisionally engaged with the cover mounting portion 13, thereby preventing the rotation of the main body cover 31. These rotation restricting portions 46, 47, as shown in FIG. 2, are formed on the wall 45 provided at the side portion of the attachment portion 31A.

In addition, the attachment portions 31A, 33A of the main body cover 31 and the lid cover 33 are provided at the other side thereof with large-diameter portions 31B, 33B into which an annular convex portion 14 provided at an end portion of the cover mounting portion 13 of the connector housing 10 is inserted.

In addition, the main body cover 31 is provided with the wire guide portion 34 which serves to bend and guide in an orthogonal direction the wire W which is pulled out from the rear portion of the connector housing 10 and which is wound by the tape T together with the wire W (see FIGS. 11 and 12). Also, the main body cover 31 is provided on the outer surface thereof with a reinforcing rib 50 for reinforcing the rigidity of the main body cover 31 over the range from the base portion of the wire guide portion 34 up to the wall 45 provided with the rotation restricting portions 46, 47 through the large diameter portion 31B or the attachment portion 31A.

Further, the locking projection 41 is provided at an end portion opposite to the hinge 32 of the main body cover 31, and the lock arm 43 having a lock hole 44 into which the locking projection 41 is inserted is provided at an end portion opposite to the hinge 32 of the lid cover 33. When the lid cover 33 is combined with the main body cover 31, as shown in FIG. 10, the lock arm 43 is engaged with the locking projection 41, the lid cover 33 and the main body cover 31 are thereby held in a combined state, and the cover mounting portion 13 of the connector housing 10 is sandwiched between the attachment portion 31A of the main body cover 31 and the attachment portion 33A of the lid cover 33, so that the wire cover 30 is actually attached to the connector housing 10.

In the case where a connector with a wire cover is assembled, first, the terminal 20 connected to the end of the wire W is inserted into each of the terminal accommodating chambers 12 at the inlet of the rear portion thereof. Once inserted, the packing member 21 that is mounted in advance on the outer periphery of the end of the wire W is press-fitted in the terminal accommodating chambers 12, and the gap between the wire W and the connector housing 10 is thereby sealed. When the connector has been assembled by inserting the total terminals 20, while the wire W pulled out in a backward direction from the rear portion of the connector housing 10 is bent in the direction that the wire cover 130 guides the wire W, as shown in FIGS. 4 to 8, the attachment portion 31A of the main body cover 31 is provisionally attached to the cover mounting portion 13 of the rear portion of the connector housing 10.

Next, in this state, the lid cover 33 is rotated as indicated by the arrow Y1 of FIG. 9, the lid cover 33 is combined with the main body cove 31 as shown in FIG. 10, and the locking projection 41 and the lock arm 43 are thereby locked together. Finally, as shown in FIGS. 11 and 12, the wire W is fixed in a bent state with the tape T by winding the tape T on the wire guide portion 34 that is provided integrally with the main body cover 31. In such a manner, the assembly of the connector with the wire cover is completed, and it is possible to guide the wire W in a predetermined direction while protecting the wire W with the wire cover 30.

During this assembly work, since the attachment portion 31A of the main body cover 31 is extended to a position beyond the maximum diameter of the cover mounting portion 13 and the provisional engagement portions 48, 49 for the cover mounting portion 13 are provided at the extended ends thereof, it is possible to prevent the main body cover 31 from being detached in the state where the main body cover 31 is provisionally mounted to the connector housing 10.

In addition, as shown in FIG. 9, since the main body cover 31 is provided with a rotation restricting portion 46, 47 to collide with the rib 18 or the lock arm protecting frame 16 of the connector housing 10 thereby restricting the rotation of the main body cover, it is possible to hold the main body cover 31 so as not to be rotated even in the case where the rotational force is applied in such a direction as arrow Y1 or Y2 when the lid cover 33 is combined with the main body cover 31.

Therefore, there is no need to work with both hands in such a manner as a worker combines the lid cover 33 and the main body cover 31 together with one hand while pressing the main body cover 31 so as not to rotate with the other hand, it is possible to easily combine the lid cover 33 with the main body cover 31 with one hand, and it is possible to mount the wire cover 30 to the housing.

In particular, in this embodiment, by rotating the lid cover 33 toward the main body cover 31 by means of the hinge 32 to lock together the main body cover 31 and the lid cover 33, it is possible to combine the main body cover 31 and the lid cove 33, accordingly to easily mount the wire cover 30 on the connector housing 10, thereby improving the assembly workability.

The present invention is not limited to the embodiments described above, but appropriate modifications, improvements, etc. thereto are possible. In addition, in the embodiments described above, material, shape, size, arrangement, location number, etc. of the respective components are arbitrary, not limited as long as the present invention can be achieved.

For example, in the above embodiments, the lid cover 33 is connected to the main body cover 31 by means of the hinge 32, but the main body cover 31 and the lid cover 33 may be formed separately by omitting the hinge 32.

In the above embodiments, the cover mounting portion 13 is oval-shaped, but it may be formed with an oval-shaped section.

The present application is based on Japanese Patent Application No. 2011-286393 filed on Dec. 27, 2011, the contents of which are incorporated herein by way of reference.

INDUSTRIAL APPLICABILITY

According to the present invention, there is provided a connector provided with a wire cover that can be attached to a connector housing easily with one hand thereby providing good workability in assembly.

The invention claimed is:

1. A connector with a wire cover, comprising:

a connector housing having a terminal accommodating chamber to which a terminal is inserted;

a wire cover, configured to protect and guide a wire which is connected to the terminal inserted into the terminal accommodating chamber and is pulled out in a predetermined direction through a wire lead-out portion of the connector housing, and including a main body cover mounted on the connector housing and a lid cover combined with the main body cover so that the wire cover is mounted on the connector housing; and a cover mounting portion provided at a rear portion of the connector housing and having a circular or oval cross-section so as to surround the wire lead-out portion;

attachment portions, respectively provided in the main body cover and the lid cover, and formed in a cylinder shape surrounding the cover mounting portion in a state where the lid cover is combined with the main body cover, thereby mounting the wire cover on the connector housing, wherein one of the attachment portions provided in the main body cover is extended beyond a maximum diameter portion of the cover mounting portion in a direction perpendicular to an attachment direction in which the attachment portion is mounted on the cover mounting portion, the one of the attachment portions includes a provisional engagement portion provisionally engaged on the cover mounting portion at an end part of the one of the attachment portions, and configured to prevent the attachment portion from being detached from the cover mounting portion, and the main body cover includes a rotation restricting portion configured to come in contact with the connector housing to prevent a rotation of the main body cover when a rotational force is applied to the main body cover in a circumferential direction of the cover mounting portion in a state where the provisional engagement portion is provisionally engaged with the cover mounting portion.

2. The connector according to claim 1, wherein the main body cover and the lid cover are rotatably connected at one end thereof to each other by a hinge, and the main body cover and the lid cover respectively include at the other end thereof lock portions configured to be locked each other when the lid cover is combined with the main body cover.

* * * * *